US008990027B2

(12) United States Patent
Hovhanessian et al.

(10) Patent No.: US 8,990,027 B2
(45) Date of Patent: Mar. 24, 2015

(54) METHOD AND DEVICE FOR MONITORING THE STATE OF A FOUNDATION EMBEDDED IN THE GROUND

(75) Inventors: Gilles Hovhanessian, Antony (FR); Frédéric Bourquin, La Varenne Saint Hilaire (FR)

(73) Assignees: Soletanche Freyssinet, Rueil Malmaison (FR); Institut Francais des Sciences et Technologies des Transports, De L'Amenagement et des Reseaux, Marne La Valle, Cedex (FR)

( * ) Notice: Subject to any disclaimer, the term of this patent is extended or adjusted under 35 U.S.C. 154(b) by 490 days.

(21) Appl. No.: 13/147,525

(22) PCT Filed: Jan. 29, 2010

(86) PCT No.: PCT/FR2010/050147

§ 371 (c)(1),
(2), (4) Date: Aug. 2, 2011

(87) PCT Pub. No.: WO2010/086566

PCT Pub. Date: Aug. 5, 2010

(65) Prior Publication Data

US 2011/0295523 A1 Dec. 1, 2011

(30) Foreign Application Priority Data

Feb. 2, 2009 (FR) ..... 09 50656

(51) Int. Cl.
*E02D 33/00* (2006.01)
*E02D 1/08* (2006.01)

(52) U.S. Cl.
CPC . *E02D 1/08* (2013.01); *E02D 33/00* (2013.01)
USPC ..... 702/41

(58) Field of Classification Search
CPC ..... E02D 33/00
USPC ..... 702/41
See application file for complete search history.

(56) References Cited

U.S. PATENT DOCUMENTS

| | | | | |
|---|---|---|---|---|
| 5,424,596 | A * | 6/1995 | Mendenhall et al. | 310/328 |
| 6,606,569 | B1 * | 8/2003 | Potts | 702/41 |
| 8,290,718 | B2 * | 10/2012 | Lee et al. | 702/34 |
| 2009/0210158 | A1 * | 8/2009 | German | 702/2 |

FOREIGN PATENT DOCUMENTS

| | | | |
|---|---|---|---|
| EP | 1 443 208 | A1 | 8/2004 |
| FR | 2 871 570 | A1 | 12/2005 |
| FR | 2 901 291 | A1 | 11/2007 |

(Continued)

*Primary Examiner* — Bryan Bui
(74) *Attorney, Agent, or Firm* — McKenna Long & Aldridge LLP

(57) ABSTRACT

The invention relates to a method for monitoring the state of a foundation supporting a building (I) and embedded in the ground, consisting of using a plurality of sensors (4, 5) arranged on the building to acquire a set of measurements ($m_{i1}$, $m_{i2}$) relating to the foundation and/or to the building according to a predetermined acquisition mode; calculating, from said set of measurements, a set of condition indicators ($i_{J1}$,$i_{J2}$) characteristic of an embedding rigidity of the foundation; and making a comparison between a set of values derived from the set of calculated condition indicators and a set of thresholds.

18 Claims, 5 Drawing Sheets

(56) References Cited

FOREIGN PATENT DOCUMENTS

| | | | |
|---|---|---|---|
| JP | 05128331 | A | 5/1993 |
| JP | 10183659 | A | 7/1998 |
| JP | 3145776 | U | 10/2008 |

* cited by examiner

METHOD AND DEVICE FOR MONITORING THE STATE OF A FOUNDATION EMBEDDED IN THE GROUND

This application is a 35 U.S.C. §371 National Stage entry of International Application No. PCT/FR2010/050147, filed on Jan. 29, 2010, and claims priority to French Patent No. 09 50656, filed Feb. 2, 2009, each of which is hereby incorporated by reference in its entirety as if fully set forth herein.

BACKGROUND OF THE INVENTION

1. Field of the Invention

The present invention relates to the monitoring of the state of a foundation embedded in the ground.

Such monitoring may in fact be desirable, notably in certain situations likely to result in damage or even destruction of the foundation, and consequently of a structure borne by this foundation.

Such situations may, for example, include natural phenomena such as floods, earthquakes or landslips.

To illustrate the proposal, the non-limiting example of a bridge on piers that are partially immersed in a river is taken hereinbelow.

In certain conditions, undermining may occur at the level of the piers. This is an effect of erosion, gradual or abrupt, of the ground around and underneath the piers, caused by the flow of river water, particularly if this flow is turbulent.

Since the structure of the ground is then modified around and underneath the piers, the balance of said piers may be altered vertically and/or in rotation.

Significant undermining may lead to embrittlement or even rupture of the piers, which could cause the deck of the pier to drop suddenly.

This phenomenon definitely represents one of the main causes of bridge collapse.

It may be aggravated in the case of river flooding because, in this case, the erosion of the ground is abruptly accelerated and is accompanied by an increase in the thrust of the water on the piers and possibly impacts due to floating objects driven by the river in flood.

The rupture mode of a pier, likely to occur in such circumstances, globally follows the following sequence:

- the ground is undermined gradually clearing the base of the pier;
- the forces, which should be transmitted to the head of the pier and be dissipated into the ground, are applied lower down in the foundation, i.e. in an area which usually has little reinforcement and which is not engineered to take up these forces;
- this effect is amplified until the foundation ruptures, followed rapidly by the rupturing of the pier as a whole.

Such a rupture is called "brittle" rupture and is not necessarily preceded by a gradual tilting of the pier.

2. Description of Related Art

A number of techniques for detecting undermining are known.

A first group of techniques consists in taking, occasionally or periodically, a reading of the surface of the ground at the bottom of the water.

This reading may be manual, for example by using a rod from the surface, by having divers make sketches or take photographs, or by using sonars.

As a variant, the reading may be automated or semi-automated. As an example, a remotely controlled submarine equipped with a camera may be used.

Schematically, these techniques address the level of the ground on the river bed. A lower ground level indicates the existence of an undermining.

A second group of techniques consists in having permanent instrumentation to make it possible to take readings of the same type as in the preceding case, but more regularly.

The instrumentation comprises, for example, a metal collar sliding on an immersed rod inserted vertically into the ground, and a magneto-inductive measuring device for measuring the position of the collar on the rod.

In another configuration, the device may consist of a weight suspended by a cable by a toothed wheel. A measuring device measures the position of the toothed wheel, and therefore the gradual lowering of the weight.

In all cases, the measurement relies on the lowering of an object by gravity as the ground is eroded, and on measuring the position of the object. A lowering of the object also reveals a lowering of the ground level, which may reflect the existence of an undermining.

The techniques of these two groups present a certain number of drawbacks.

Since they are based on a measurement of the ground level, they allow only for the detection of the presence of an undermining formed at the position of the sensor. It is therefore possible that a foundation that is at risk will not be detected because the ground is undermined at a different point from that where the sensor is positioned, or because there is no clear undermining. The rupture of the foundation as a result of the undermining may be abrupt, as described above, so such a detection may not be early enough.

Nor are these techniques effective for use in adverse conditions, such as floods for example. That is obvious when it comes to the production of manual readings. However, even in the case of automated readings, the instrumentation placed on the surface of the water or in the water will generally not withstand the conditions.

As an example, the abovementioned rod and magnetic collar may be carried away by the current and the sonar may be damaged or even destroyed after having been struck by objects carried by the water in cases of flood.

Furthermore, while undermining is generally characterized by a lowering of the ground level, other effects capable of unbalancing the foundation until it drops may exist.

However, the abovementioned techniques are specific to the detection of undermining due to water flows and do not allow other risks that might weaken the foundation to be tracked.

Thus, a decompression of the ground, for example associated with land movements during an earth tremor, may lead to a loss of strength of the foundation (the decompacted ground no longer serves as an abutment for the foundation) without thereby significantly acting on the height of the ground. Such an effect cannot be detected with the prior art techniques outlined above.

Similarly, nor will a build-up of sediments, gradual or abrupt as a result, for example, of a landslip, be detected by the automated monitoring systems that rely on the heavy weight principle.

Moreover, the correct operation of the abovementioned techniques is difficult to control remotely. It is not possible, for example, to know if the measuring system based on a weight placed on a rod or suspended on a wire is jammed, by an object carried by the river for example, or because the components are corroded thereby. If the weight is jammed, the undermining will not be detected, and there will be no way of knowing about it without carrying out an in-situ check.

Nor do these techniques allow for the effectiveness of a repair to be checked. If an undermining is detected, it will be backfilled, generally with rubble. The prior art techniques do not make it possible to assess the capacity of this repair to provide the foundation with the necessary horizontal abutment.

An article by Y. Fujino and D. M. Siringoringo entitled "Structural health monitoring for risk assessment of bridges: concept and implementations" and published in November 2008 very briefly raises the possibility of providing piers with a bridge of inclinometers, in order to detect their collapse as a result of an undermining.

However, the inclination of a bridge pier may be normal, in particular when it occurs in response to a strong horizontal thrust exerted by the river water. In itself, it therefore does not constitute a relevant indicator.

Furthermore, given that the rupture of the pier may be abrupt as described above, it is in fact the collapse of the pier that is observed by this technique. The technique cannot, in practice, anticipate the collapse.

BRIEF SUMMARY OF THE INVENTION

One aim of the present invention is to limit at least some of the drawbacks of the abovementioned techniques.

The invention thus proposes a method for monitoring the state of a foundation supporting a structure and embedded in the ground. This method comprises the following steps:

- acquiring, using a set of sensors placed on the structure, a set of measurements relating to the foundation and/or to the structure, according to a determined mode of acquisition;
- computing, from said set of measurements, a set of state indicators characteristic of an embedding stiffness of the foundation; and
- performing a comparison between a set of values derived from the set of computed state indicators and a set of thresholds.

Thus, the monitoring of the state of the foundation is based on an analysis of its embedding stiffness, which is representative of its hold in the ground. The focus is therefore directly on the foundation and on the supported structure, rather than the possible external manifestation of a phenomenon which may destabilize the foundation, such as erosion of the ground for example.

The embedding stiffness may advantageously include the horizontal or rotational stiffness of the foundation, which is representative of the abutting ground resistance, that is to say the capacity of the ground to withstand the horizontal forces that are transmitted to it by the foundation.

In this way, the monitoring can be more precise. It allows for earlier detection of changes to the embedding condition of the foundation, and therefore makes it possible to better anticipate the effects that may cause it to be damaged, or even ruined.

This monitoring also makes it possible to detect a wider variety of effects, because any loss of hold of the foundation in the ground is detected, regardless of its cause and its consequences (undermining having the effect of lowering the ground level, decompression of the ground possibly without alteration of its level, local undermining on only a part of the foundation, etc).

Furthermore, since the sensors used are placed on the structure (advantageously at a great distance from the foundation), they are less exposed to risks of damage or destruction than certain devices of the abovementioned prior art. In particular, when the foundation is at least partially immersed, the sensors are advantageously at a distance from the water, which protects them in particular when the flow of water becomes violent.

Furthermore, the sensors can be used after a reinforcement of the ground to characterize its effectiveness.

Furthermore, the solution used can be covered by a remote diagnostic facility and it does not risk being inoperative for example at the time of a flood.

Also, this solution can be used to detect and diagnose a reduction or an increase in the embedding stiffness of the foundation, linked to effects other than underminings (earth tremors, build-up of deposits, etc.).

It will also be noted that, in this description and in the claims, whenever reference is made to a set of elements, regardless of the elements concerned, such a set should be interpreted as being able to include a single element or a plurality of elements.

Advantageously, one or more parameters of the mode of acquisition of the measurements may vary depending on the value of at least one state indicator of said set of state indicators and/or of another indicator such as a level of water around the foundation. The monitoring of the state of the foundation can thus be adapted according to the circumstances, so improving any appraisal or decision-taking that may possibly follow.

The invention also proposes a system for monitoring the state of a foundation supporting a structure and embedded in the ground. This system is organized to implement the abovementioned method and it comprises:

- a set of sensors which can be placed on the structure, said set of sensors being organized to acquire a set of measurements relating to the foundation and/or to the structure, according to a determined mode of acquisition;
- a computer for computing, from said set of measurements, a set of state indicators characteristic of an embedding stiffness of the foundation; and
- a comparator for performing a comparison between a set of values derived from the set of computed state indicators and a set of thresholds.

BRIEF DESCRIPTION OF THE SEVERAL VIEWS OF THE DRAWINGS

Other features and advantages of the present invention will become apparent from the following description of exemplary, non-limiting embodiments, with reference to the appended drawings in which.

BRIEF DESCRIPTION OF THE INVENTION

The invention will be described hereinbelow, in a non-limiting manner, in the context of the monitoring of the state of the foundation of a bridge on piers. It nevertheless applies to any other type of foundation supporting a structure and embedded in the ground. This foundation may possibly be located in an area subject to natural risks such as floods, earthquakes or landslips.

Figure 1:
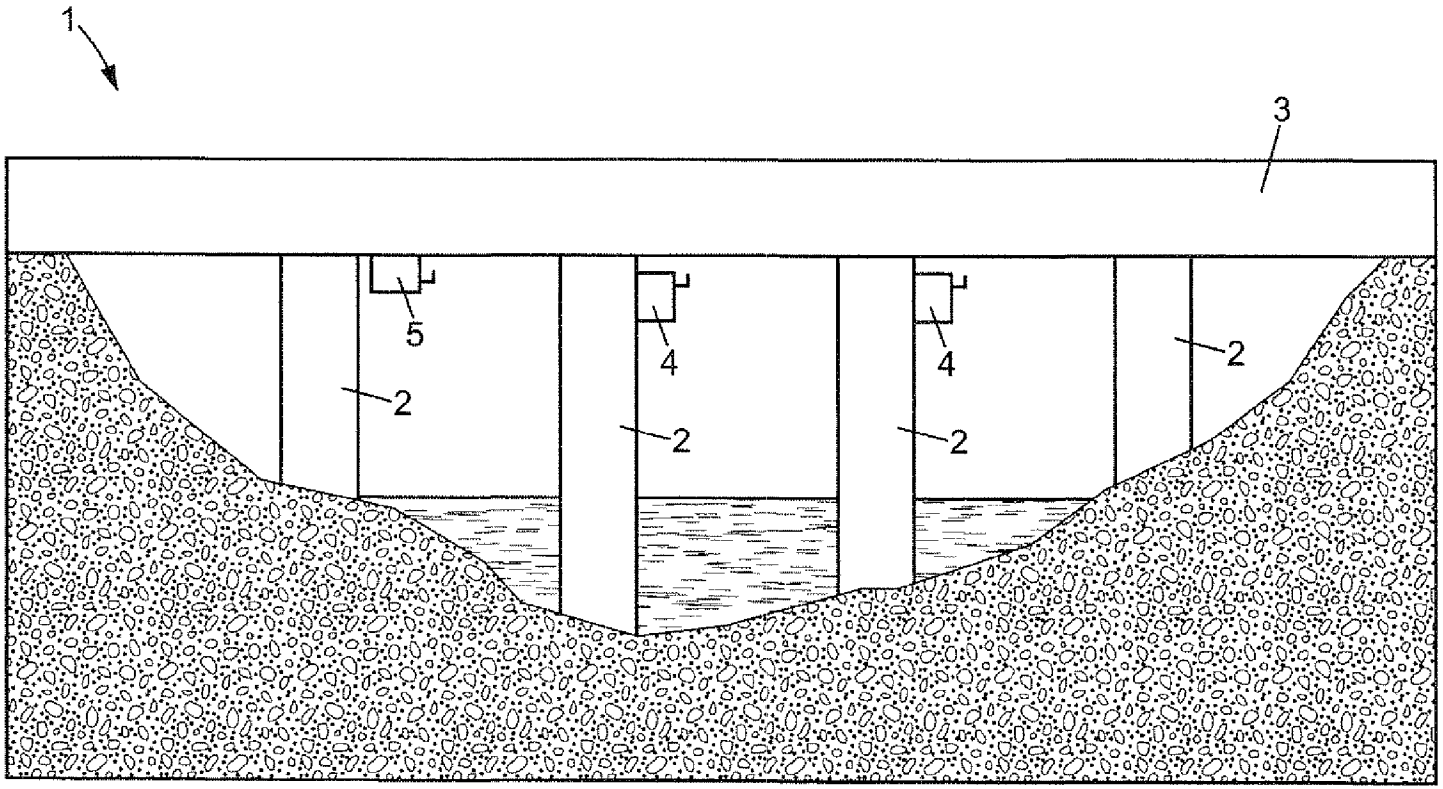
FIG. 1 is a diagram representing an exemplary system for monitoring the state of a foundation of a bridge on piers.

FIG. 1 shows an example of a bridge 1 comprising a deck 3 and a certain number of piers 2 supporting the deck 3. The foundations of each of the piers 2 are embedded in the ground. In the example illustrated, the bridge crosses a river, and two of the piers 2 have a bottom portion immersed in this river. Obviously, the invention would also apply to other bridge configurations.

Figure 2:
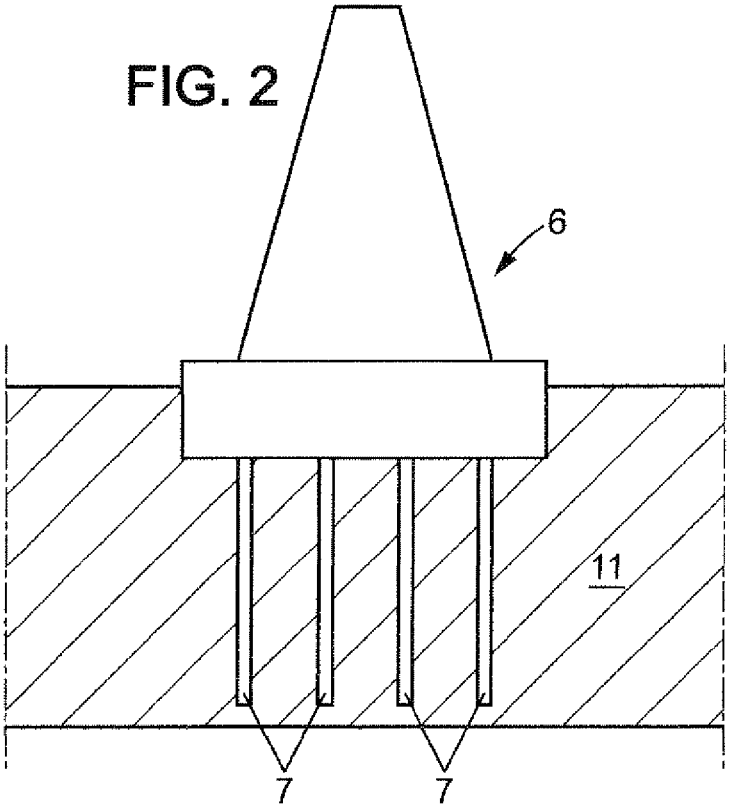
FIG. 2 is a diagram representing a first exemplary foundation for a bridge pier.
Figure 5:
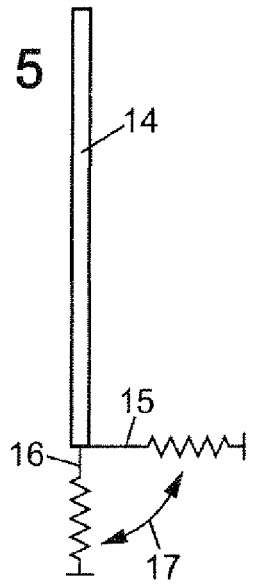
FIG. 5 is a diagram representing an exemplary modeling of the embedding stiffness of the foundation shown in FIG. 4.

A bridge on piers generally uses one of the following two types of foundations for each of its piers:

- a deep foundation, in which piles 7 supporting the pier 6 are driven into the ground 11, as illustrated in FIG. 2, or
- a superficial foundation, in which only a bottom portion of the pier 12 is embedded in the ground 13, as illustrated in FIG. 5.

It will therefore be understood that each pier 6 or 12 may to a certain extent be involved in the foundation (in its bottom part), while forming part of the supported structure, that is to say of the bridge (in its top part).

Many other types of foundations could naturally be envisaged.

In all cases, it can be shown that a foundation supporting a structure may be the subject of a modeling. This modeling may for example consist, in the case of a foundation of a bridge pier, of a variable-inertia beam maintained by springs and/or dampers working in translation and/or in rotation and simulating the behavior of the ground.

Figure 3:
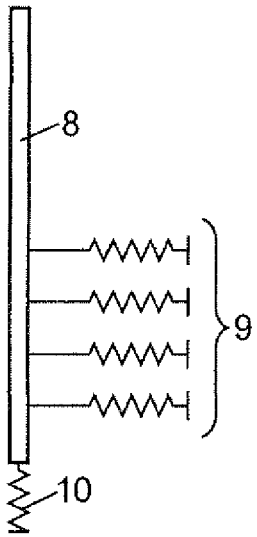
FIG. 3 is a diagram representing an exemplary modeling of the embedding stiffness of the foundation shown in FIG. 2.

A model of the configuration shown in FIG. 2 is illustrated in FIG. 3. This shows a variable-inertia beam 8, a series of springs/dampers 9 working in horizontal translation, and a spring/damper 10 working in vertical translation.

Figure 4:
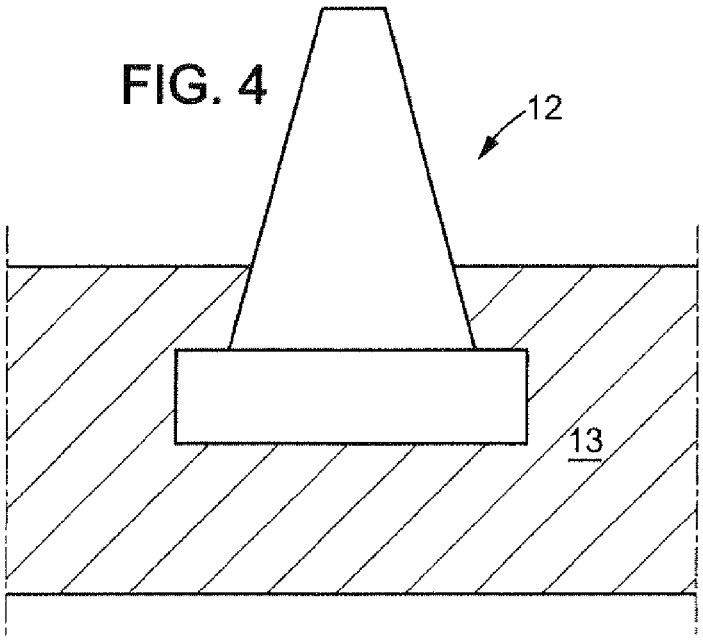
FIG. 4 is a diagram representing a second exemplary foundation for a bridge pier.

Similarly, a possible model for the configuration shown in FIG. 4 is illustrated in FIG. 5. This model comprises a variable-inertia beam 14, a spring/damper 15 working in horizontal translation, a spring/damper 16 working in vertical translation and a spring/damper 17 working in rotation.

In the two examples of models mentioned above, account may also be taken of a beam head bearing condition, representative of the type of bearing of the bridge deck on the pier concerned (e.g. sliding bearing, fixed bearing, pot bearing, etc.).

Other models can also obviously be envisaged.

Such theoretical models make it possible to simulate the behavior of the foundation embedded in the ground.

From a given model, a set of state indicators characteristic of an embedding stiffness of the foundation can be defined.

The embedding stiffness of the foundation is understood here to mean the ratio of the force applied to the foundation and the displacement of the foundation caused by this force. This concept covers the concepts of vertical, horizontal or rotational stiffness, which respectively correspond to a vertical or horizontal force or to a torque on a vertical or horizontal displacement or an angular rotation.

The embedding stiffness may include a static stiffness which corresponds to a static force, that is to say a force corresponding to a slow or substantially constant stress. It may also include the concept of dynamic stiffness which corresponds to a dynamic force, which can be expressed as a sum of periodic stresses of more or less high frequencies. The dynamic stiffness may, in certain cases, vary according to the frequency of the stress.

In addition to the set of state indicators, it is possible to define, for the selected model, a set of thresholds to which a set of values derived from the set of state indicators can be compared.

These thresholds are advantageously chosen to correspond to noteworthy states of the foundation, as will become apparent later. They may be absolute thresholds defining absolute limiting values for said values derived from the set of state indicators, or else relative thresholds defining a limiting amplitude of variation for said values derived from the set of state indicators. A combination of absolute thresholds and relative thresholds is also possible.

The set of state indicators may comprise a wide variety of state indicators.

By way of example, one or more of these state indicators characteristic of a static embedding stiffness of the foundation could be used. In the case of a partially immersed bridge pier, it is thus possible to use, as state indicator, a ratio between the force applied by the water to the pier and an inclination of the pier relative to its main axis, possibly in a given plane. It will be noted that such an indicator is much more relevant than a simple inclination, a high value of which may be perfectly normal if it coincides with a strong horizontal thrust of the water, but abnormal in cases of weak thrust.

As a variant or in addition, one or more of the state indicators characteristic of a dynamic embedding stiffness of the foundation could be used. It is possible for example to cite an indicator characteristic of a vibratory behavior of the foundation+structure assembly, such as an indicator relating to specific vibration frequencies of the foundation and structure as a whole. In the case of a bridge on piers crossing a river, a drift in the specific vibration frequencies of the foundation+bridge assembly supported by the foundation, and in particular of the first tilt mode about a horizontal axis perpendicular to the course of the river, in fact gives a good indication of the risk of the foundation and/or of the structure being ruined.

Focus is now concentrated on the monitoring of the state of a real foundation supporting a structure and embedded in the ground.

To this end, a set of sensors are placed on the structure. FIG. 1 illustrates this situation in the case where the structure concerned is a bridge 1 on piers 2.

In this example, two of the sensors 4 used are placed on corresponding piers 2. They are nevertheless located high enough on the piers so as not to be too exposed to risks of damage or destruction, for example as a result of a flooding of the river passing under the bridge 1. The third sensor 5 is placed under the deck 3 close to a pier 2 of the bridge 3. Obviously a different number and/or positioning of the sensors can be envisaged.

These sensors are arranged to acquire certain measurements relating to the foundation and/or to the structure from which the set of state indicators characteristic of an embedding stiffness of the foundation, as mentioned above, can be obtained.

Each sensor may be dedicated to a given type of measurement, but it is also possible for at least some of the sensors used to be multipurpose and be able to acquire all or some of the set of said measurements. Devices each including a group of dedicated sensors may possibly be used.

At least some of the sensors may have data processing and storage capabilities. Moreover, at least some of the sensors may be battery-operated and include wireless communication means to communicate with a remote unit and/or between themselves.

Figure 9:
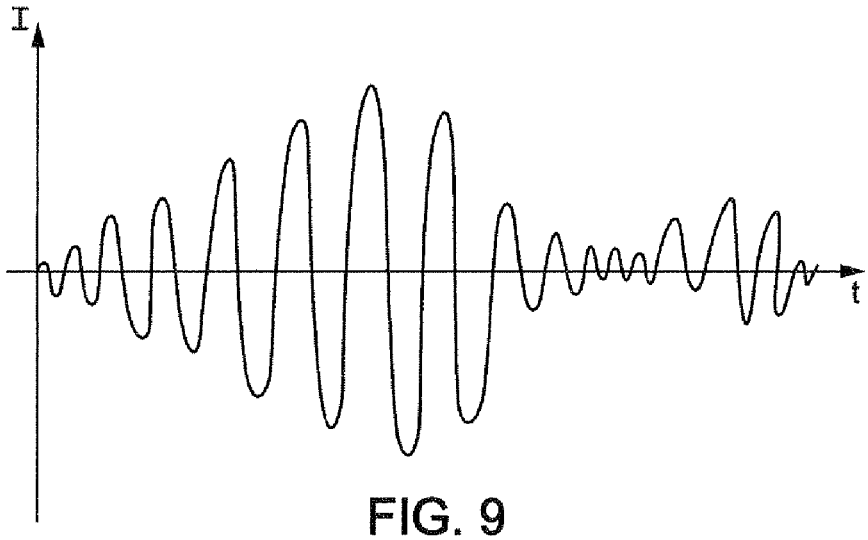
FIG. 9 is a diagram representing an example of measurement acquired by a sensor.

The measurements that may be acquired by the sensors are adapted to the type of state indicators to be computed. As an example, a measurement of inclination I of a pier relative to its main axis, possibly in a given plane, may be acquired over the time t, as shown in FIG. 9. Such a measurement may be acquired using an inclinometer.

A value of the state indicator described above such as the ratio between the force applied by the water to the pier and an inclination of the pier can thus be computed from such a measurement, and from a measurement of the force applied by the water to the pier.

Similarly, the measurement shown in FIG. 9 can be used to compute specific vibration frequencies of the foundation+bridge supported by the foundation, also defined above as a possible state indicator.

As a variant or in addition, the vibratory behavior of the foundation+bridge assembly could be measured using one or more accelerometers.

Many other measurements can be envisaged as will be apparent to those skilled in the art.

Figure 6:
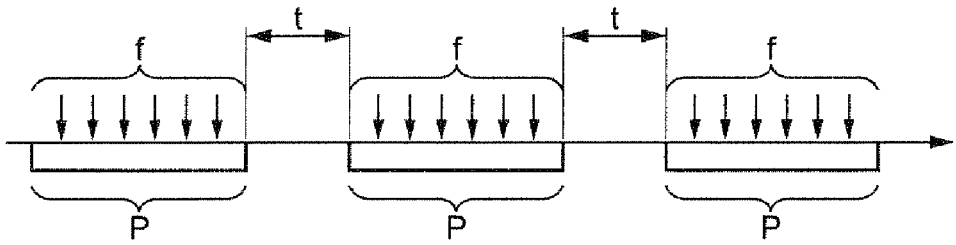
FIG. 6 is a diagram showing different parameters of a method of acquiring measurements relating to a foundation and/or a supported structure.

These measurements are acquired according to a determined mode of acquisition, for which non-limiting examples of parameters are illustrated in FIG. 6.

The acquisition parameters that make up the acquisition mode notably comprise the definition of one or more determined time periods P, during which the measurements are acquired. Within each of these periods P, an acquisition frequency f may also be defined: it corresponds to the number of measurements acquired during P. Furthermore, when a number of time periods P are used for the acquisition, the time interval t between two successive periods may constitute another acquisition parameter.

Other acquisition parameters can be used instead of or in addition to the parameters P, f and t mentioned above.

All or some of these acquisition parameters may be fixed or indeed vary over time. Examples of events that can trigger a modification of one or more of these parameters will be described later.

A set of state indicators characteristic of an embedding stiffness of the foundation can then be computed from the set of measurements acquired using the sensors. Such a set of state indicators has already been defined above.

When the sensors are provided with data processing and storage capabilities, they can advantageously compute and store the state indicators themselves, preferably in real time. By storing only these state indicators, rather than the measurements acquired, the volume of data to be stored is limited.

Otherwise, the sensors may advantageously transmit at least some of the measurements acquired and/or some of the computed state indicators to a remote data processing and/or storage unit, for example via a wireless link. When this remote unit is out of range of a given sensor, the signals transmitted by the latter may advantageously be relayed by one or more other sensors to reach said remote unit.

Values can then be derived from the computed state indicators in order to be compared to a set of thresholds. These thresholds may be chosen according to an expected behavior of the foundation and of the supported structure, for example from a theoretical model as mentioned above.

It will be noted that these values may be directly those of the computed state indicators, when the latter can be compared to the thresholds. Otherwise, they may result from the application of mathematical functions to one or more of the computed state indicators (change of scale or of unit of a state indicator, combination of state indicators, etc.).

As an example, a comparison may be made between the state indicator corresponding to the ratio between the force applied by the water to a pier and an inclination of this pier, and a corresponding threshold.

Advantageously, the comparison between the set of values derived from the computed state indicators and the set of thresholds may take into account one or more influencing factors that may affect at least one of the state indicators.

These influencing factors include, for example, one or more of: the temperature (thermal gradient), the wind, the creep of a material incorporated in the foundation or the structure or the frequency of a force applied to the foundation. The load supported by the structure, for example because of traffic borne by the structure, may also constitute an influencing factor.

Sensors, which may be associated with or, otherwise, distinct from the sensors mentioned above, may be used to measure these influencing factors. They may comprise a temperature sensor, an anemometer for the wind, a deformation gauge for the creep, a load detector, etc.

These influencing factors may be taken into account in the comparison by adapting the computed state indicators and/or the thresholds appropriately. As an example, the value of a state indicator involving the inclination of a bridge pier could be modified to compensate for the contribution of the effect of the wind effect in this inclination. The comparison between this value and a predetermined threshold would thus not be distorted by the effect of the wind.

Based on the result of the comparison, an appraisal may be made and/or a decision may be taken concerning operation of the structure.

Making an appraisal may involve generating a diagnosis of the state of the foundation.

Taking a decision concerning the operation of the structure may, for example, include closing or restricting the operation of this structure. Thus, when the structure concerned is a bridge, the decision-taking may, for example, consist in reducing or stopping traffic over this bridge.

Using the set of state indicators characteristic of an embedding stiffness of the foundation thus provides a reliable means of detecting, as early as possible, a loss of hold of the foundation in the ground. Because of this, an undermining may be anticipated, well before the ruin of the foundation.

Furthermore, since the interest is focused directly on the foundation and on the structure themselves, rather than on any consequences able to affect them (lowering of the ground level for example in the case of an undermining), the detection is also more reliable and more accurate.

It is also possible to detect and anticipate effects, other than underminings, which may nevertheless lead to damage or even the ruin of the foundation and of the structure, such as decompressions of the ground (e.g. ground with decompacted sediments), earthquakes, landslips, other natural risks, etc.

Assuming that a theoretical modeling has been done initially and that at least some of thresholds intended to be used in the monitoring of the state of the foundation have been derived from this modeling, a learning phase may advantageously be implemented before the actual operational monitoring.

Figure 8:
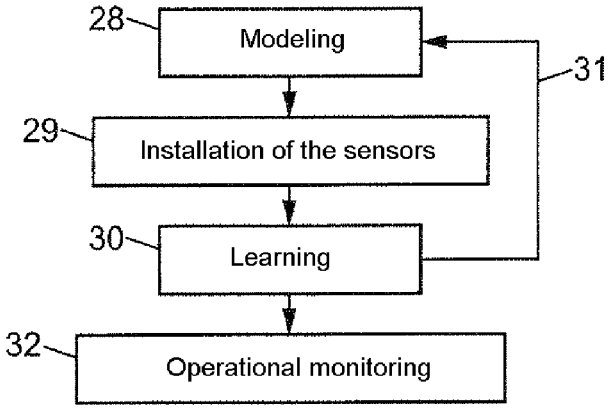
FIG. 8 is a diagram representing a sequence of advantageous steps preceding an operational monitoring.

This situation is illustrated in FIG. 8. The learning phase (step 30) may be conducted after the modeling of the embedding stiffness of the foundation (step 28) and the installation of the sensors on the structure (step 29). It consists in adjusting the thresholds defined on the basis of the theoretical modeling by measurements from the sensors. It is advantageously carried out under natural stresses (wind, traffic, etc.).

There is thus an assurance that the thresholds used in operational monitoring (step 32) will be well suited to the foundation concerned in practice. The embedding condition of the foundation in the ground can thus be correctly tracked and analyzed.

The analysis of the embedding stiffness of the foundation is advantageously done according to the natural stresses and the response of the foundation to these natural stresses. The two main stresses envisaged are the thrust of the water in the case of foundations in rivers, and road or rail traffic. Assuming that these natural stresses are insufficient, and for example would not sufficiently stress the tilt modes of the foundation, it would nevertheless be possible to envisage artificially stressing the foundation, for example using vibrators, by having trucks brake, by having them pass over humps, or by some other means.

Figure 7:
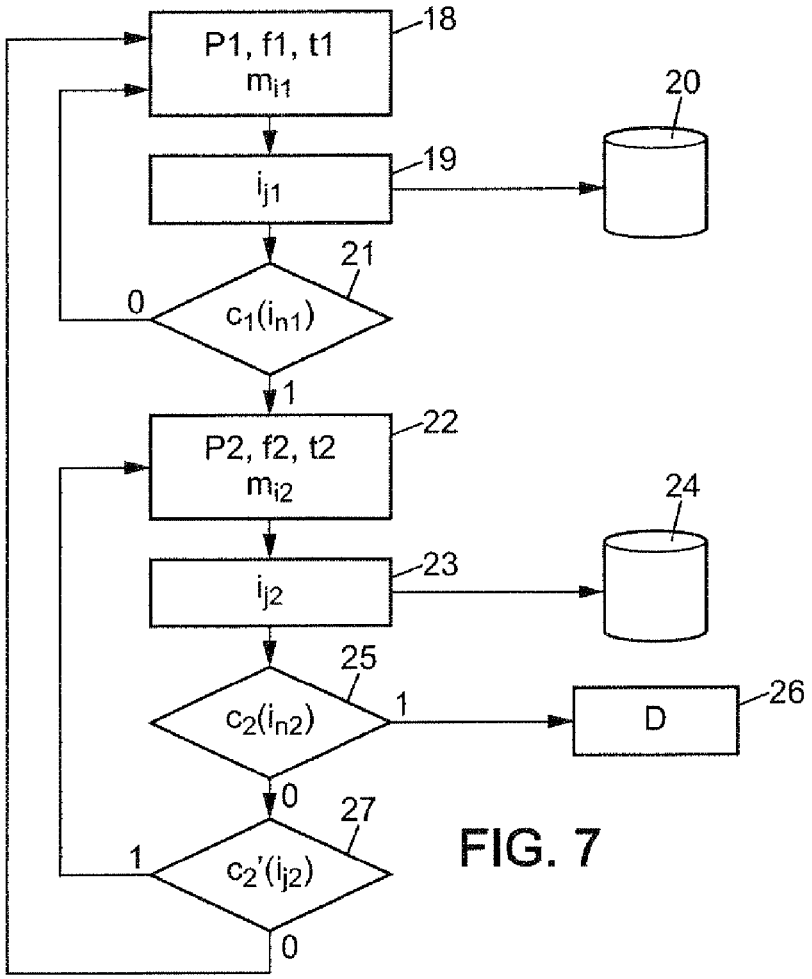
FIG. 7 is a diagram representing the steps of an example of monitoring of the state of a foundation.

An example of monitoring of the state of a foundation of a bridge on piers, embedded in the ground, will now be described with reference to FIG. 7, as an illustration.

Firstly, a routine monitoring is carried out. This corresponds to a normal mode, in which the stresses exerted on the foundation are a priori of usual amplitude.

This monitoring includes the acquisition of measurements $m_{i1}$ by a set of sensors, according to a first acquisition mode whose parameters may comprise, as described with reference to FIG. 6, a time period P1 over which the measurements are acquired, an acquisition frequency f1 for each period P1 and/or a time interval t1 between two successive periods P1 (step 18).

As an example, the acquisition of the measurements in routine monitoring may be done over periods of 5 minutes separated by intervals of two hours, and with an acquisition frequency of 500 Hz. Obviously these values are given as an illustration and many other values could be used.

The routine monitoring continues, in the step 19, with the computation of a set of state indicators $i_{j1}$ characteristic of an embedding stiffness of the foundation, from the measurements $m_{i1}$ and according to the principles explained above.

At least some of these state indicators $i_{j1}$ may be archived in an appropriate memory, which may be that of the sensors or of a separate unit, for the purposes of a possible subsequent analysis (step 20).

In the step 21, a check is made as to whether a condition $c_1$ is satisfied or not by one or more indicators $i_{n1}$ of the set of computed state indicators $i_{j1}$. This condition may take various forms. It includes the comparison of at least one value derived from $i_{n1}$ with one or more suitable thresholds.

As an example, the state indicator $i_{n1}$ could consist of a ratio between the force applied by the water of a river on a pier of the bridge and an inclination of this pier, and be compared with a predetermined threshold.

As a variant, the condition $c_1$ could apply to an indicator that is not part of the set of computed state indicators $i_{j1}$, and that does not directly provide information concerning the embedding stiffness of the foundation.

For example, such an indicator could relate to a level of water around the foundation. This indicator could also be computed from one of the sensors mentioned above, or else from an independent sensor, such as an ultrasound sensor or a radar for example.

In this case, the condition checked in the step 21 could include a comparison between this water level and a threshold for example characteristic of a flood. This threshold may be expressed as an absolute height of water, as a ratio between the height of water and the height of the structure, as a variation of the height of water, or in some other way.

In this way, when the condition of the step 21 is not satisfied (which is symbolized by the value "0" at the output of the test $c_1(i_{n1})$), this may indicate that the level of the river passing under the bridge is not excessive and that it is possible to remain in normal mode with the same routine monitoring as previously.

Otherwise, that is to say if the condition of the step 21 is satisfied (which is symbolized by the value "1" at the output of the test $c_1(i_{n1})$), this may mean that the river is in flood and therefore that the risks of undermining and other effects that may lead to a destabilization of the foundation are increasing.

It is then possible to switch to another mode, which is a "flood mode" in this example. In this new mode, an increased monitoring is implemented.

Measurements $m_{i2}$ are acquired using the sensors according to a second acquisition mode, which comprises acquisition parameters P2, f2 and t2, at least some of which have values different from P1, f1 and t1 (step 22).

For example, a continuous acquisition may be performed in "flood mode". In other words, a single period P2 of undefined duration is used. As for the acquisition frequency f2, this may be the same as f1, e.g. at 500 Hz, or even faster, to have more measurements.

It will thus be understood that at least one acquisition parameter may vary according to the value of at least one state indicator ($i_{n1}$ in this case) or of another indicator (e.g. a level of water around the foundation).

In the step 23, a set of state indicators characteristic of an embedding stiffness of the foundation is computed from the measurements $m_{i1}$ and according to the principles explained above. This computation is advantageously carried out concurrently with the acquisition, that is to say in real time, possibly over a sliding time window.

At least some of these state indicators $i_{j2}$ may be archived in an appropriate memory, which may be that of the sensors or of a separate unit, for the purposes of a possible subsequent analysis (step 24).

In the step 25, a check is made to see if the condition $c_2$ is satisfied or not by one or more indicators $i_{n2}$ of the set of computed state indicators $i_{j2}$. This condition may take various forms. It includes the comparison of at least one value derived from $i_{n2}$ with one or more suitable thresholds.

Advantageously, the thresholds used in this comparison are chosen to anticipate a risk of ruin of the foundation.

A number of thresholds may also be used with regard to the same state indicators, so as to allow for an appraisal or for a decision D to be taken appropriately depending on the situation (step 26).

As an example, the overshoot of a first threshold only by one given state indicator could lead to a restriction on the traffic over the bridge, whereas the overshoot of a second threshold greater than the first could result in traffic over the bridge being totally prohibited.

Different alarm and alert levels could thus be defined, with corresponding appropriate actions.

When the condition c2 is not (or is no longer) satisfied, an additional condition $c_2'$ may be checked on all the state indicators $i_{j2}$, or even only some of them (step 27), to check whether the operation in "flood mode" is still justified ("1"), or else whether a return to the normal mode is possible ("0").

In the case of a return to the normal mode, the routine monitoring mentioned above is then resumed.

It will be understood that many other examples of monitoring can be defined according to the principles of the invention that are explained above. In particular, other adaptations of the acquisition strategy could be used according to the data collected using the sensors.

The invention claimed is:

1. A method for monitoring the state of a foundation supporting a structure and embedded in the ground, comprising the following steps:

acquiring, using a set of sensors placed on the structure, a set of measurements relating to the foundation and/or to the structure, according to a determined mode of acquisition;

computing, from said set of measurements, a set of state indicators characteristic of an embedding stiffness of the foundation;

performing a comparison between a set of values derived from the set of computed state indicators and a set of thresholds; and evaluating a state of the foundation based on a result of said comparison.

2. The method as claimed in claim 1, wherein the set of state indicators includes at least one indicator characteristic of a dynamic embedding stiffness of the foundation, that is to say relating to a ratio between a dynamic force applied to the foundation and a displacement of the foundation caused by said dynamic force.

3. The method as claimed in claim 2, wherein said indicator characteristic of a dynamic embedding stiffness of the foundation is characteristic of a vibratory behavior of the foundation and structure assembly, such as an indicator relating to specific vibration frequencies of the foundation and structure as a whole.

4. The method as claimed in claim 1, wherein the set of state indicators includes at least one indicator characteristic of a static embedding stiffness of the foundation.

5. The method as claimed in claim 1, wherein the comparison between a set of values derived from the set of computed state indicators and a set of thresholds takes into account at least one influencing factor that may affect at least one state indicator of the set of state indicators.

6. The method as claimed in claim 5, wherein the at least one state indicator is temperature, wind, creep of a material incorporated in the foundation or the structure of the frequency of a force applied to the foundation.

7. The method as claimed in claim 1, wherein at least one parameter of said determined mode of acquisition varies according to the value of at least one state indicator of said set of state indicators.

8. The method as claimed in claim 7, wherein the at least one parameter is a time period over which the set of measurements is acquired, a time interval between two successive time periods over which the set of measurements is acquired, or a frequency of acquisition within a time period over which the set of measurements is acquired.

9. The method as claimed in claim 1, wherein an appraisal is made and/or a decision concerning operation of the structure is taken, based on a result of said comparison.

10. The method as claimed in claim 9, wherein said decision includes closure or restriction of operation of the structure.

11. The method as claimed in claim 1, wherein at least some of the thresholds of said set of thresholds are chosen on the basis of a theoretical modeling of the embedding stiffness of the foundation.

12. The method as claimed in claim 11, wherein at least some of the thresholds of said set of thresholds are adjusted by measurements performed during a learning phase.

13. The method as claimed in claim 1, wherein the foundation is located in an area subject to natural risks such as floods, earthquakes or landslips.

14. The method as claimed in claim 1, wherein at least one parameter of said determined mode of acquisition varies according to a water level around the foundation.

15. The method as claimed in claim 14, wherein at least one parameter of said determined mode of acquisition is a time period over which the set of measurements is acquired, a time interval between two successive time periods over which the set of measurements is acquired, or a frequency of acquisition within a time period over which the set of measurements is acquired.

16. The method as claimed in claim 1, wherein at least one sensor of said set of sensors has data processing and storage capabilities.

17. The method as claimed in claim 1, wherein at least one sensor of said set of sensors is battery-operated and includes wireless communication means.

18. A system for monitoring the state of a foundation supporting a structure and embedded in the ground, the system organized to implement the method as claimed in claim 1, system comprising:

a set of sensors which can be placed on the structure, said set of sensors organized to acquire a set of measurements relating to the foundation and/or to the structure, according to a determined mode of acquisition;

a computer for computing, from said set of measurements, a set of state indicators characteristic of an embedding stiffness of the foundation; and a comparator for performing a comparison between a set of values derived from the set of computed state indicators and a set of thresholds.

* * * * *